US007810349B2

(12) United States Patent
Kelly

(10) Patent No.: US 7,810,349 B2
(45) Date of Patent: Oct. 12, 2010

(54) RAPID FLUID COOLING APPARATUS AND METHOD

(76) Inventor: Patrick Laughlin Kelly, 4205 Lenore La., NW., Washington, DC (US) 20008

( * ) Notice: Subject to any disclaimer, the term of this patent is extended or adjusted under 35 U.S.C. 154(b) by 973 days.

(21) Appl. No.: 11/453,966

(22) Filed: Jun. 16, 2006

(65) Prior Publication Data

US 2006/0283203 A1 Dec. 21, 2006

Related U.S. Application Data

(60) Provisional application No. 60/691,320, filed on Jun. 16, 2005.

(51) Int. Cl.
*F25D 3/08* (2006.01)

(52) U.S. Cl. ..... 62/457.5; 62/62

(58) Field of Classification Search ..... 62/62, 62/371, 400, 457.2, 457.5
See application file for complete search history.

(56) References Cited

U.S. PATENT DOCUMENTS

| | | | |
|---|---|---|---|
| 93,583 | A | 8/1869 | Baldwin |
| 165,617 | A | 7/1875 | Rockstroh |
| 1,141,762 | A | 6/1915 | Brown |
| 1,166,139 | A | 12/1915 | Marwedel |
| 1,375,210 | A | 4/1921 | Clayton |
| 1,505,479 | A | 8/1924 | Maitland |
| 1,633,712 | A | 6/1927 | Ribi |
| 1,740,192 | A | 12/1929 | McNiel |
| 1,758,008 | A | 5/1930 | Mock |
| 1,768,916 | A | 7/1930 | Lancaster |
| 1,854,731 | A | 4/1932 | Beran |
| 1,944,726 | A | 1/1934 | Aiken |
| 2,427,776 | A | 9/1947 | Goldman |
| 2,610,034 | A | 9/1952 | Lundvall et al. |
| 2,677,942 | A | 5/1954 | Schott et al. |
| 2,711,881 | A | 6/1955 | Rose |
| 2,805,554 | A | 9/1957 | Schachtsiek |
| 2,997,858 | A | 8/1961 | Perez |
| 3,020,025 | A | 2/1962 | O'Mara |
| 3,168,431 | A | 2/1965 | Spielvogel |
| 3,424,733 | A | 1/1969 | Pollock |
| 3,563,710 | A | 2/1971 | Dew, Jr. et al. |
| 3,650,319 | A | 3/1972 | Boon |
| 3,770,252 | A | 11/1973 | Gordini et al. |
| 3,910,346 | A | 10/1975 | ter Braak |
| 3,910,347 | A | 10/1975 | Woebcke |
| 3,952,538 | A | 4/1976 | Warlick |
| 4,040,768 | A | 8/1977 | Christian |
| 4,577,474 | A | 3/1986 | Peterson |
| RE32,169 | E | 6/1986 | Piotrowski |
| 4,656,840 | A | 4/1987 | Loofbourrow et al. |
| 4,671,856 | A | 6/1987 | Sears |

(Continued)

*Primary Examiner*—Melvin Jones
(74) *Attorney, Agent, or Firm*—Law Office of Peter G. Korytnyk, PLLC

(57) ABSTRACT

An apparatus and method are provided for rapidly cooling small volumes of fluids. The apparatus includes a plurality of cooling elements each including a housing forming a sealable cooling fluid chamber which can house a cooling fluid. At least one spacer is arranged to separate opposed cooling elements and provide a separation distance between the opposed cooling elements. Each of the plurality of cooling elements is arranged to be independently separable to allow ready assembly, disassembly, and cleaning. The plurality of cooling elements can include a stack of disc-shaped cooling elements or concentric cylinders that can be situated in a container and rotated by a motor.

20 Claims, 13 Drawing Sheets

U.S. PATENT DOCUMENTS

| | | | | |
|---|---|---|---|---|
| 5,058,396 | A | 10/1991 | Faiola | |
| 5,469,708 | A | 11/1995 | Harrison et al. | |
| 5,487,492 | A | 1/1996 | Goulet | |
| 5,701,747 | A | 12/1997 | Faiola et al. | |
| 5,931,005 | A | 8/1999 | Garrett et al. | |
| 6,105,490 | A | 8/2000 | Horn et al. | |
| 6,152,019 | A | 11/2000 | Heyde | |
| 6,238,524 | B1 | 5/2001 | Zebuhr | |
| 6,397,624 | B1 | 6/2002 | Horwell | |
| 6,574,981 | B2 | 6/2003 | Schroeder | |
| 6,681,841 | B1 | 1/2004 | Dale | |
| 6,732,533 | B1 * | 5/2004 | Giles | 62/3.3 |
| 2003/0146241 | A1 | 8/2003 | Moothart et al. | |

* cited by examiner

RAPID FLUID COOLING APPARATUS AND METHOD

CROSS REFERENCE TO RELATED APPLICATION

The present application claims the benefit from earlier filed U.S. Provisional Patent Application No. 60/691,320, filed Jun. 16, 2005, which is incorporated herein in its entirety by reference. The present application also incorporates by reference International Application PCT/US06/0236021 entitled "Rapid Fluid Cooling Apparatus and Method" naming as inventor Patrick L. Kelly filed on the same date as the present application.

FIELD OF THE INVENTION

The present invention relates to an apparatus and method for rapidly cooling fluids. In particular, the present teachings relate to an apparatus and device incorporating a plurality of independently separable cooling elements each housing a chillable fluid and arranged in an opposed relationship with one another through the use of spacers. When cooled or frozen, the cooling elements act as thin ice sheets that are capable of achieving rapid fluid cooling of relatively small volumes of fluids.

BACKGROUND OF THE INVENTION

Various known devices have been developed to cool liquids. In-line cooling devices operate by directing liquids through tortuous conduits having cooled surfaces. Another known device includes a sealable liquid container that is placed in direct contact with ice or other refrigerant. Another approach involves submersing a chilled or frozen element into a liquid.

The aforementioned in-line cooling devices conduct warm fluids through an extended, convoluted course defined by cooling elements. However, it is difficult if not impossible to guide limited volumes of fluids through such convoluted courses. Moreover, the internal surfaces of in-line cooling devices are usually not directly accessible for cleaning and cannot be readily disassembled because the internal elements are sealed to form the convoluted conduits. The cooling elements of in-line cooling devices are usually in communication with refrigerant that is supplied by an external pump thereby necessitating permanent cooling line connections that can make disassembly additionally complex.

Similarly, cooling devices that cool fluids utilizing substantially parallel opposed surfaces, such as heat sinks, generally have inaccessible or at best hard to reach surfaces as the plates forming the opposed surfaces are permanently secured.

Separable opposed cooling elements are known but are incapable of achieving rapid cooling. For example, water or other freezable liquids encased in plastic housings in the shape of cubes are incapable of cooling liquids from room temperature to a refrigerator temperature on the order of tens of seconds. Such plastic ice cubes cannot be readily ordered and packed to produce the surface-to-volume ratio required to achieve the level of rapid cooling that is desirable.

U.S. Pat. No. 4,656,840 to Loofbourrow et al. discloses separable ice containers that can be ordered, temporarily connected, and stacked through the use of integrally formed matching plugs and recesses. However, the ice containers of Loofbourrow et al. are incapable of being readily arranged with a sub-centimeter separation distance between opposingly arranged containers. It has been found that the rate of liquid cooling is extremely sensitive to the separation distance between opposed surfaces when the separation distance is small, for example, less than 1 cm. It has also been found that too small of a separation distance between opposed surfaces can cause the liquid being cooled to freeze or to become adhered to the surfaces. Manual handling of the ice containers is tedious and will not result in the consistent formation of small, optimized separation distances between ice containers. Moreover, such handling of ice containers causes them to absorb heat and reduce their cooling capacity.

Accordingly, a need exists for an apparatus and method that can rapidly cool a predetermined volume of fluid from room temperature to a refrigerator temperature within a relatively short period of time, such as approximately ten seconds or less. Such an apparatus and method should be capable of providing a high-level of cooling efficiency and be operable with multiple types of fluids.

SUMMARY OF THE INVENTION

The present teachings disclose an apparatus and method for rapidly cooling a fluid which meets at least the aforementioned needs.

According to the present teachings, the rapid fluid cooling apparatus includes a plurality of cooling elements. Each of the cooling elements includes a housing forming a sealable cooling fluid chamber capable of containing a cooling fluid. The apparatus includes at least one spacer separating opposed cooling elements and providing a separation distance between the opposed cooling elements. Further, each of the plurality of cooling elements is arranged to be independently separable.

According to the present teachings, a method of rapidly cooling a fluid includes providing a plurality of cooling elements. Each of the cooling elements includes a housing including a sealed cooling fluid chamber filled with a cooling fluid and is arranged spaced apart from an opposed cooling element. Each cooling element is also independently separable from the other cooling elements. The method further includes reducing the temperature of the plurality of cooling elements by exposing the cooling elements to a reduced temperature. The cooling elements are then arranged in a container and a fluid to be cooled is poured into the container.

Additional features and advantages of various embodiments will be set forth, in part, in the description that follows, and, in part, will be apparent from the description, or may be learned by practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings relate to an apparatus and method that utilize thin ice or cooled fluid sheets to achieve rapid cooling or chilling of various fluids. It has been found that thin sheets of cooled or frozen material are ideal for achieving rapid fluid cooling because of their high-capacity to absorb heat and their ability to provide high surface-to-volume ratios. By encasing the thin cooled sheets in thermally conductive material and separating neighboring sheets with spacers, such as posts, an effective separation distance and positioning of such thin cooling elements is possible for achieving optimized, rapid cooling of relatively small volumes of fluids. Neighboring thin cooling elements can be removably secured with respect to each other to allow ready separation and thorough cleaning. According to various embodiments, the thin cooling elements can be rotated to create strong shear forces in the liquid being cooled to encourage high-level mixing and further facilitate rapid cooling. These strong shear forces also operate to promote the cleaning of the cooling surfaces after the rapid cooling operation has been completed. Through the use of the apparatus and method of the present teachings, the cooling of a 12-ounce volume of fluid can be achieved in about 10 seconds or less.

Figure 1:
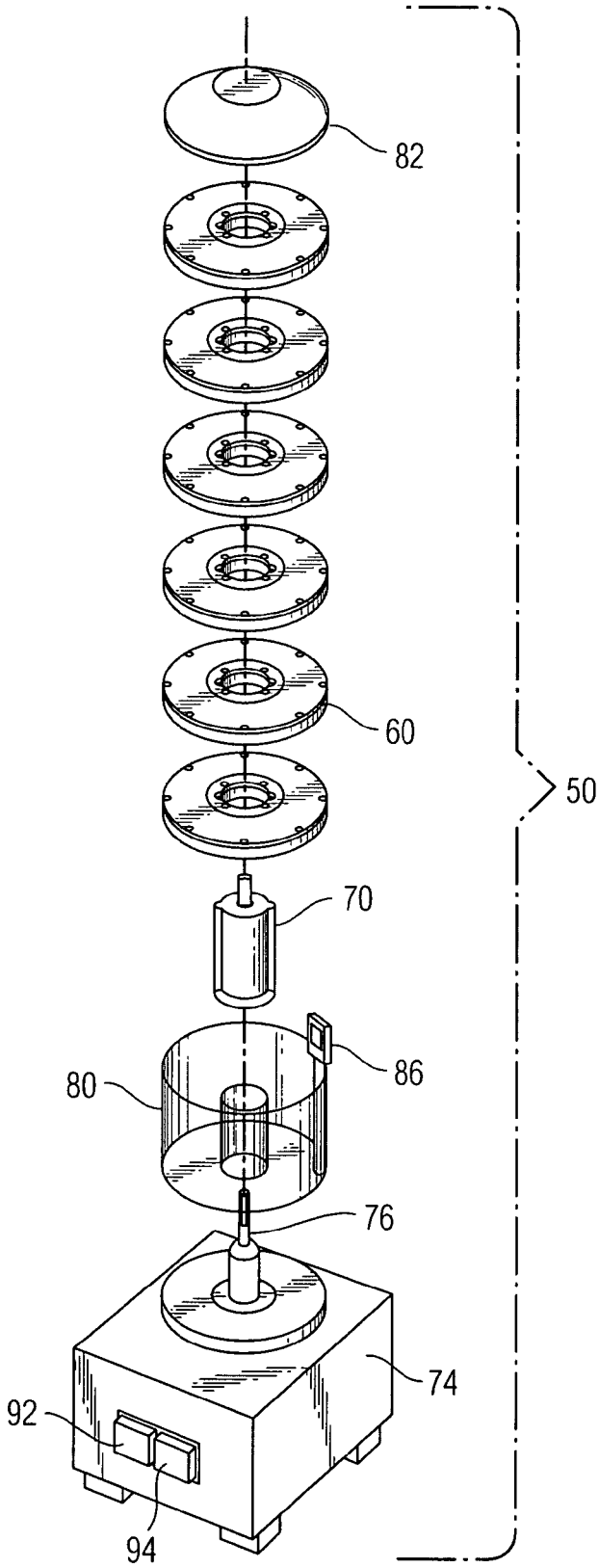
FIG. 1 is an exploded perspective view of an embodiment of the rapid cooling apparatus according to the present teachings.

FIG. 1 shows an exploded view of one embodiment of a rapid cooling apparatus 50 of the present teachings. The rapid cooling apparatus 50 includes two or more cooling elements or discs 60 that are capable of being readily stacked onto a rotatable motor spindle or shaft 76 with a predetermined separation distance between each cooling disc 60. For example, the cooling discs 60 can be slid down onto an axis extender 70 which can be arranged to be rotated by the motor shaft 76 protruding from a motor housing 74. As will be more fully discussed below, the axis extender 70 can include a keyed element which can mesh with a correspondingly shaped keyed element formed in each cooling disc 60 thereby preventing relative rotation between the cooling discs 60 and the axis extender 70. The axis extender 70 can extend through the center of a liquid container 80 and can mesh with the motor shaft 76.

Figure 2:
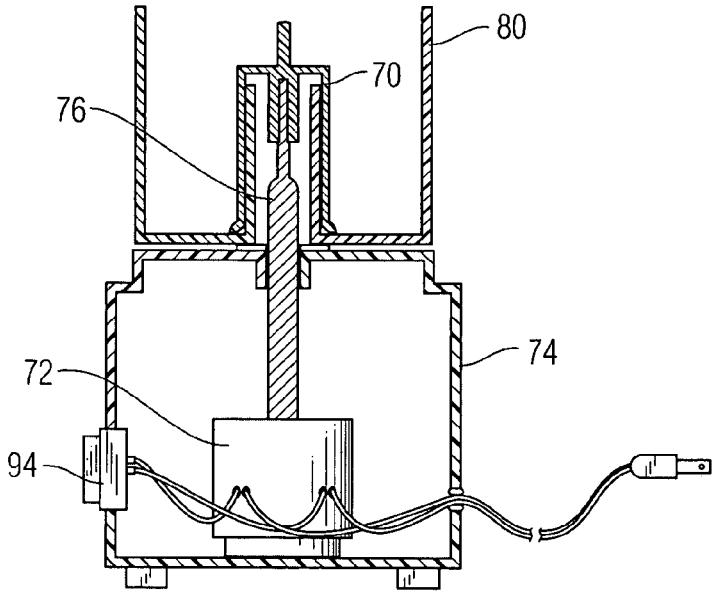
FIG. 2 is a cross-section of a motor housing and motor control according to various embodiments.

As shown in FIG. 1, the liquid container 80 can be closed by way of a lid 82 to reduce or eliminate spillage during operation of the rapid cooling apparatus 50. A temperature sensor 86, such as, for example, a thermometer, can be arranged in operative contact with the liquid container 80 to provide users with instantaneous temperature readings of the liquid being held in the liquid container 80. On a base unit of the rapid cooling apparatus 50, such as, for example, on a motor housing 74, user-actuated controls can be arranged. For example, the user-actuated controls can include a cool button 92 and a clean button 94. Referring to FIG. 2, which illustrates a front-to-back cross-section of the motor housing 74, a motor 72 and motor shaft 76 are shown in rotational operative connection with the axis extender 70. Electrical connections between the motor 72 and the clean button 94, as well as other connections are illustrated.

Figure 3:
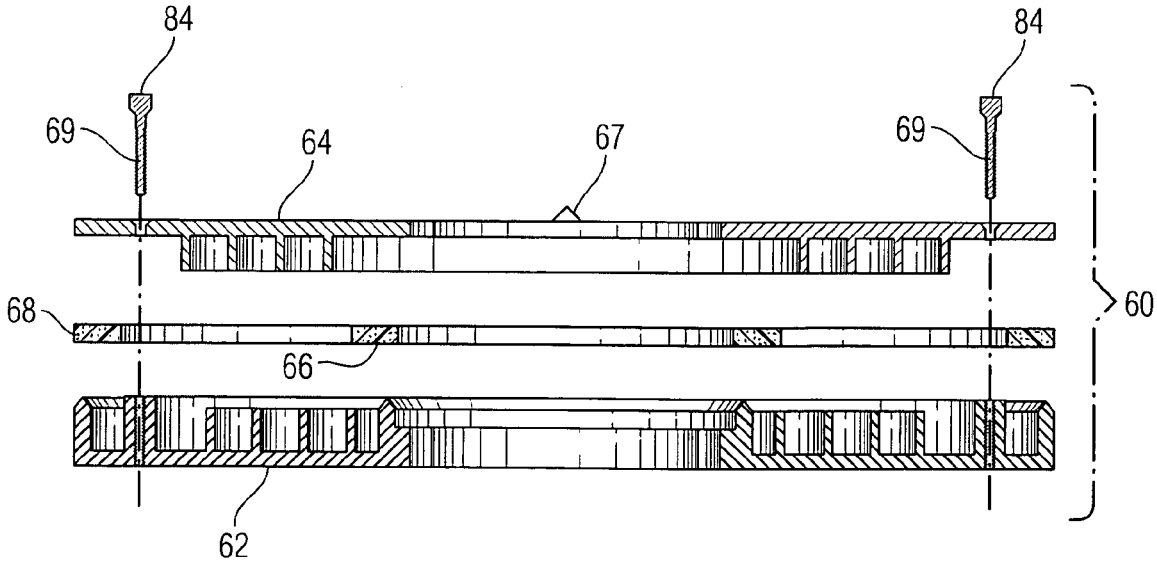
FIG. 3 shows an exploded cross-section of the components of a cooling disc according to various embodiments.

FIGS. 3-6 illustrate the structure and assembly of a cooling element or disc 60. Referring to FIG. 3, each cooling disc 60 can include a lower disc portion 62 and an upper disc portion 64. Each cooling disc 60 can be formed in an annular shape and can include an inner gasket 66 and an outer gasket 68 that allow the formation of a sealable cooling fluid chamber within each cooling disc 60. A cooling fluid, such as, for example, water, can be provided within the sealed cooling fluid chamber. Depending on the temperature of the cooling disc 60, the fluid in the cooling fluid chamber can be in at least one of a liquid, solid, or gaseous state. The cooling fluid chamber can be filled with a quantity of cooling fluid appropriate so that freezing the cooling fluid does not expand and exceed the volume of the cooling fluid chamber. When cooling or freezing the cooling discs 60, the discs 60 should be in a horizontal orientation to protect the discs 60 from expansion during freezing. The lower and upper disc portions 62, 64 can be tightly coupled to each other by way of a securing mechanism, such as screws 69 and threaded holes.

Figure 4:
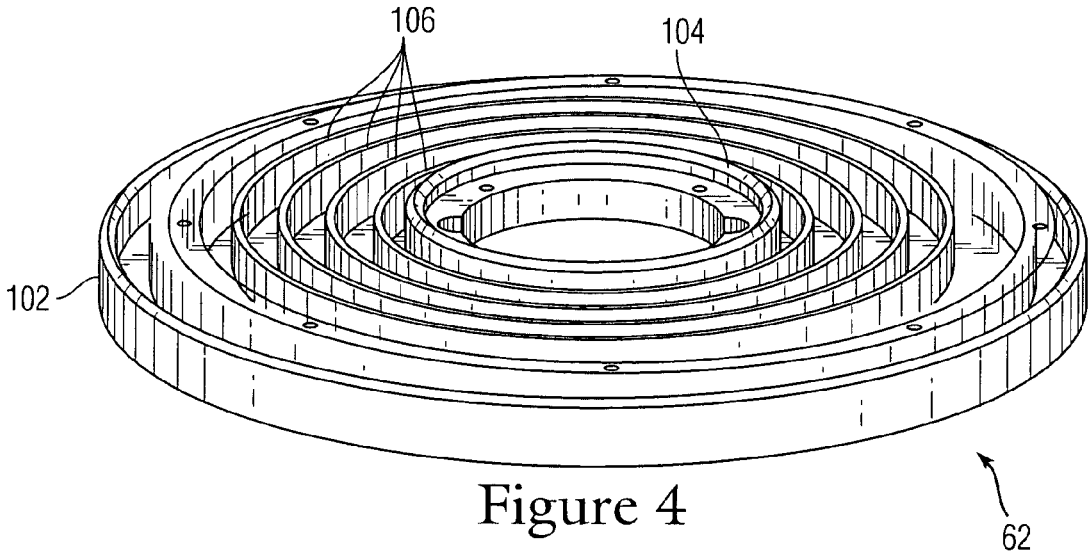
FIG. 4 is a perspective view of a lower disc portion of a cooling disc according to various embodiments.
Figure 5:
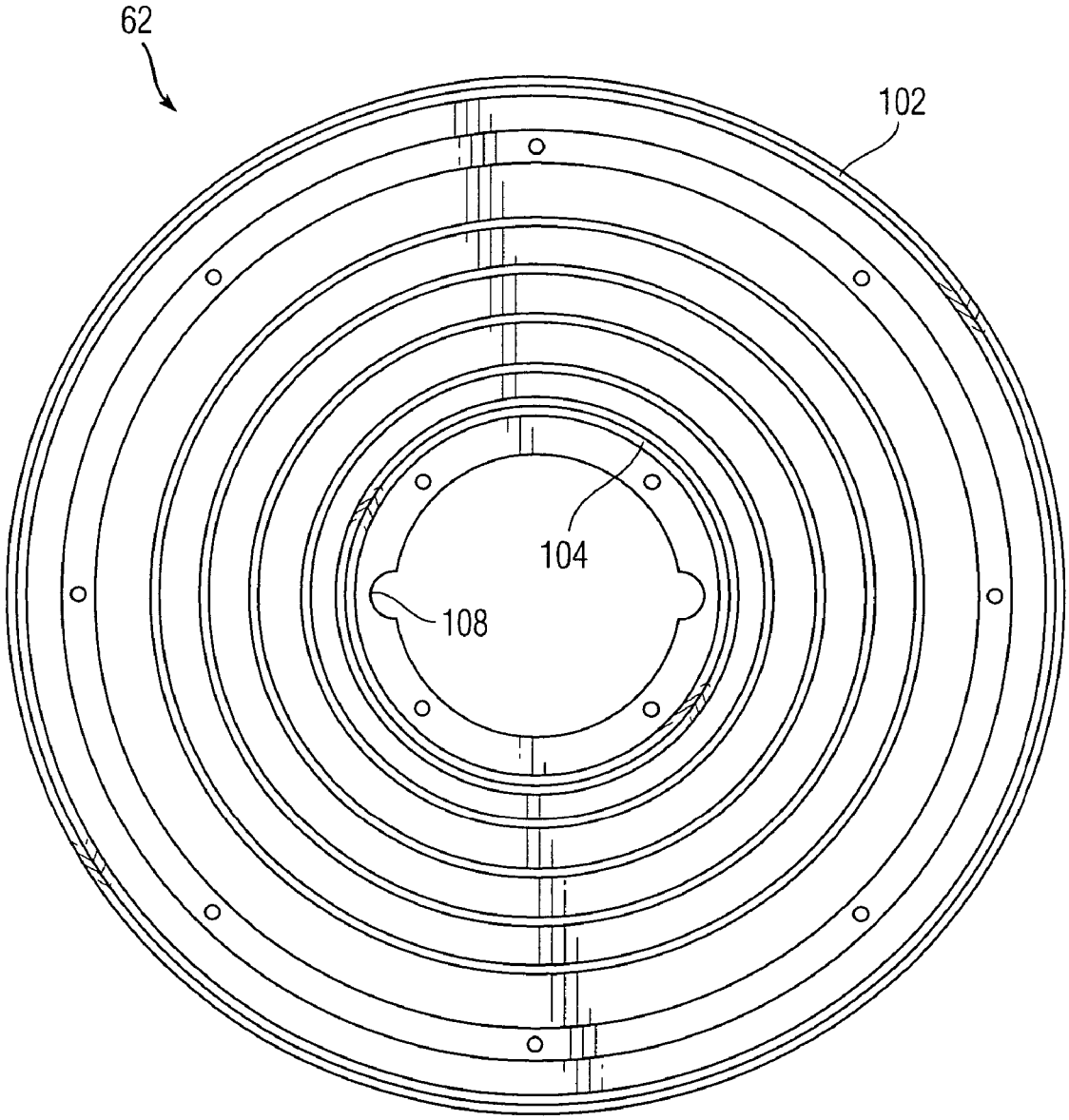
FIG. 5 is a top plan view of the lower disc portion according to various embodiments.

Referring to FIGS. 4 and 5, the lower disc portion 62 can include an outer wall 102 and an inner wall 104 that define the chamber for containing the cooling liquid when the cooling disc 60 is assembled. The lower and upper disc portions 62, 64 can be provided with fins 106 that operate to increase the surface area of the interface between the cooling disc 60 and the cooling liquid housed within the cooling disc 60. Alternatively, fins 106 can be provided on only one of the disc portions and the other disc portion can be formed as a planar cap to seal the cooling disc 60. The fins 106 can be arranged to be axially symmetric, such as, for example, forming concentrically arranged rings. The height of the fins 106 can be varied to provide complete separation between one or more annular chambers formed when a cooling disc 60 is assembled, or to provide varying levels of communication between chambers. Such concentric rings allow the cooling fluid to differentially rotate with the chamber wall creating an enhanced mixing when in both a solid and liquid state. The top portions of the inner and outer walls 104, 102 can be peaked so as to pinch the inner and outer gaskets 66, 68 when the lower disc portion 62 is secured to the upper disc portion 64. Moreover, as shown in FIG. 3, the outer surfaces of at least one of the lower and upper disc portions 62, 64 can be provided with surface undulations or projections 67 which are capable of generating turbulence during rotation of the cooling disc 60 for enhanced cooling.

Figure 6:
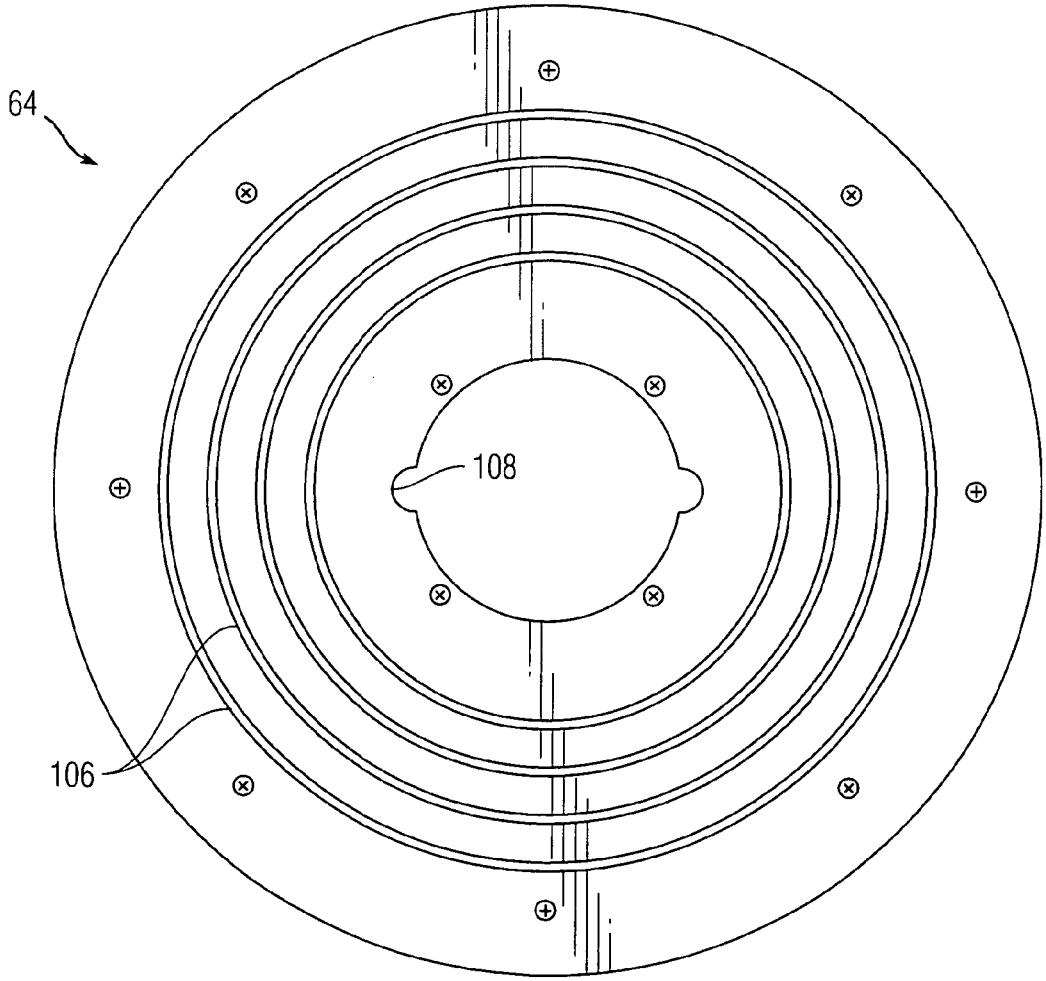
FIG. 6 is a bottom plan view of an upper disc portion of a cooling disc according to various embodiments.
Figure 7:
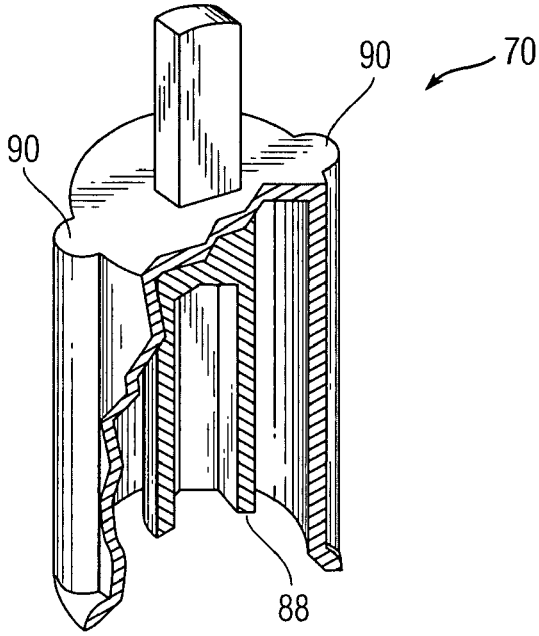
FIG. 7 is a cross-sectional, perspective view of an axis extender according to various embodiments.

As best shown in FIGS. 4-6, a key mechanism can be arranged between the cooling discs 60 and the axis extender 70 to prevent relative rotation between the cooling discs 60 and the axis extender 70 during operation. For example, the key mechanism can include notches 108 formed in the lower and upper disc portions 62, 64. As shown in FIG. 7, the axis extender 70 can include keyed protrusions 90 which can mesh with the correspondingly shaped notches 108 formed in the cooling discs 60 to transfer rotational power to the cooling discs 60.

When slid onto the axis extender 70, the cooling discs 60 can maintain a vertical spacing between opposed stacked cooling discs 60 by way of spacers. For example, as shown in FIG. 3, the spacers can include posts 84 that can extend out from surfaces of the cooling discs 60. The posts 84 can be formed by enlarged screwheads that extend from a surface of a cooling disc 60. According to various embodiments, in an assembled state, a cooling disc 60 can have a thickness of from about 2 mm to about 2 cm, and preferably can have a thickness of about 4 mm to about 5 mm. The spacers 84 can be arranged to provide a separation distance between opposed cooling discs 60 of up to about 1 cm, and preferably are arranged to provide a mean separation distance of between about 2 mm to about 3 mm, and most preferably about 2.5 mm. The diameter of each cooling disc 60 can vary depending on the desired amount of cooling and can generally range from about 5 cm to about 15 cm, and preferably can be about 10 cm. All noted dimensions can be varied depending upon the desired rate of cooling and the size of the discs.

Figure 8:
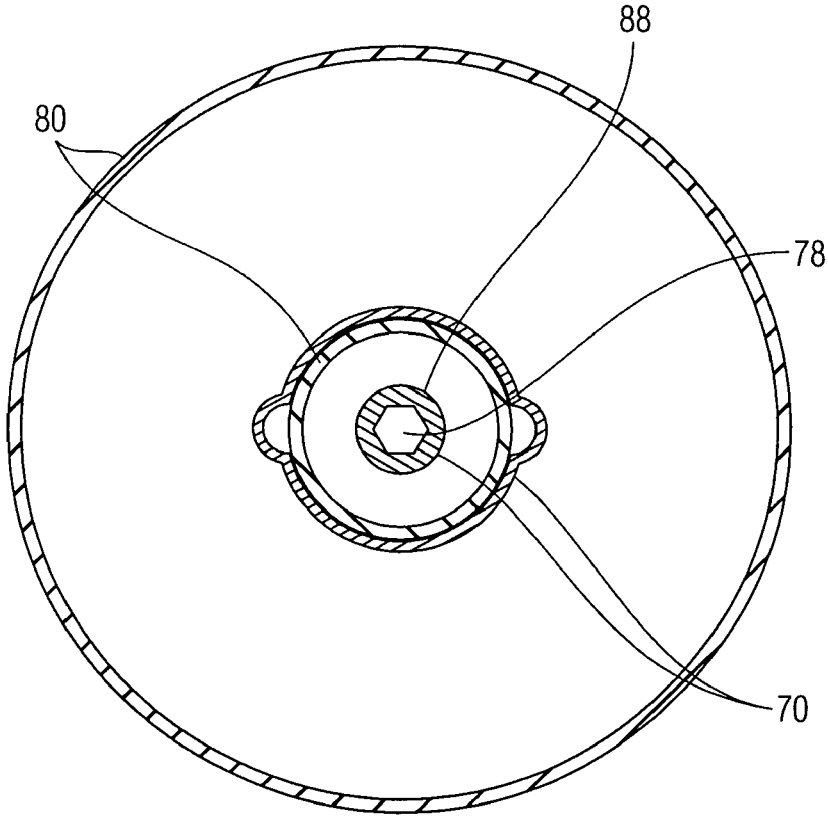
FIG. 8 is a cross-section through an axis extender and a container of the rapid cooling apparatus according to various embodiments.

Referring to FIGS. 2, 7, and 8, a structure for achieving an interconnection between the axis extender 70 and the motor shaft 76 is shown. A geometrically-shaped socket aperture 78 can be formed within an inner socket extension 88 of the axis extender 70. The geometrically-shaped socket aperture 78 can be arranged to mate with the correspondingly shaped motor shaft 76 thereby allowing rotation of the axis extender 70 and the cooling discs 60 when the motor shaft 76 is rotated. As shown in FIG. 2, the fluid container 80 is formed with a centrally arranged tube through which the motor shaft 76 can extend when the fluid container 80 is arranged in an operative position. After the fluid container 80 is secured into its operative position, the axis extender 70 and the cooling discs 60 can be slid onto the end of the motor shaft 76 and over the centrally arranged tube of the container 80. The rapid cooling apparatus 50 is now ready for operation.

The fluid container 80 and the cooling discs 60 can be stored in a reduced temperature environment, such as, for example, a freezer where they can be cooled and maintained at sub-freezing temperatures. When it is desired to cool a fluid, the fluid container 80 and cooling discs 60 can be installed onto the motor housing 74 by fitting the axis extender 70 onto the motor shaft 76. The fluid to be cooled is then added to the liquid container 80. The user can then depress the cool button 92 on the motor housing 74 to energize the motor 72 causing rotation of the cooling discs 60 at a predetermined angular frequency. The angular frequency can be constant or varied by the user during the cooling operation depending on the particular cooling requirements. A read-out from the temperature sensor 86 can display the temperature of the fluid being cooled such that the cooling operation can be slowed or stopped by de-energizing the motor 72 when a desired temperature has been reached. At this point, the liquid container 80 can be removed from the motor housing 74 and the cooled fluid poured out therefrom. Alternatively, if turbulence is expected to negatively affect properties of the fluid being cooled, the user can elect to not energize the motor 72.

To rinse or clean the rapid cooling apparatus 50, the user can fill the fluid container 80 with water and/or a cleaning solution and depress the clean button 94 on the motor housing 74. The clean button 94 can be arranged to run the motor 72 causing the cooling discs 60 to rotate at a relatively high-speed and then to abruptly stop repeatably, causing a cleaning of residues from the container 80 and cooling discs 60. For deep, thorough cleaning, the cooling discs 60 can be readily unstacked by separating them from the axis extender 70 and hand-cleaning or placing them into a dishwasher.

Figure 9:
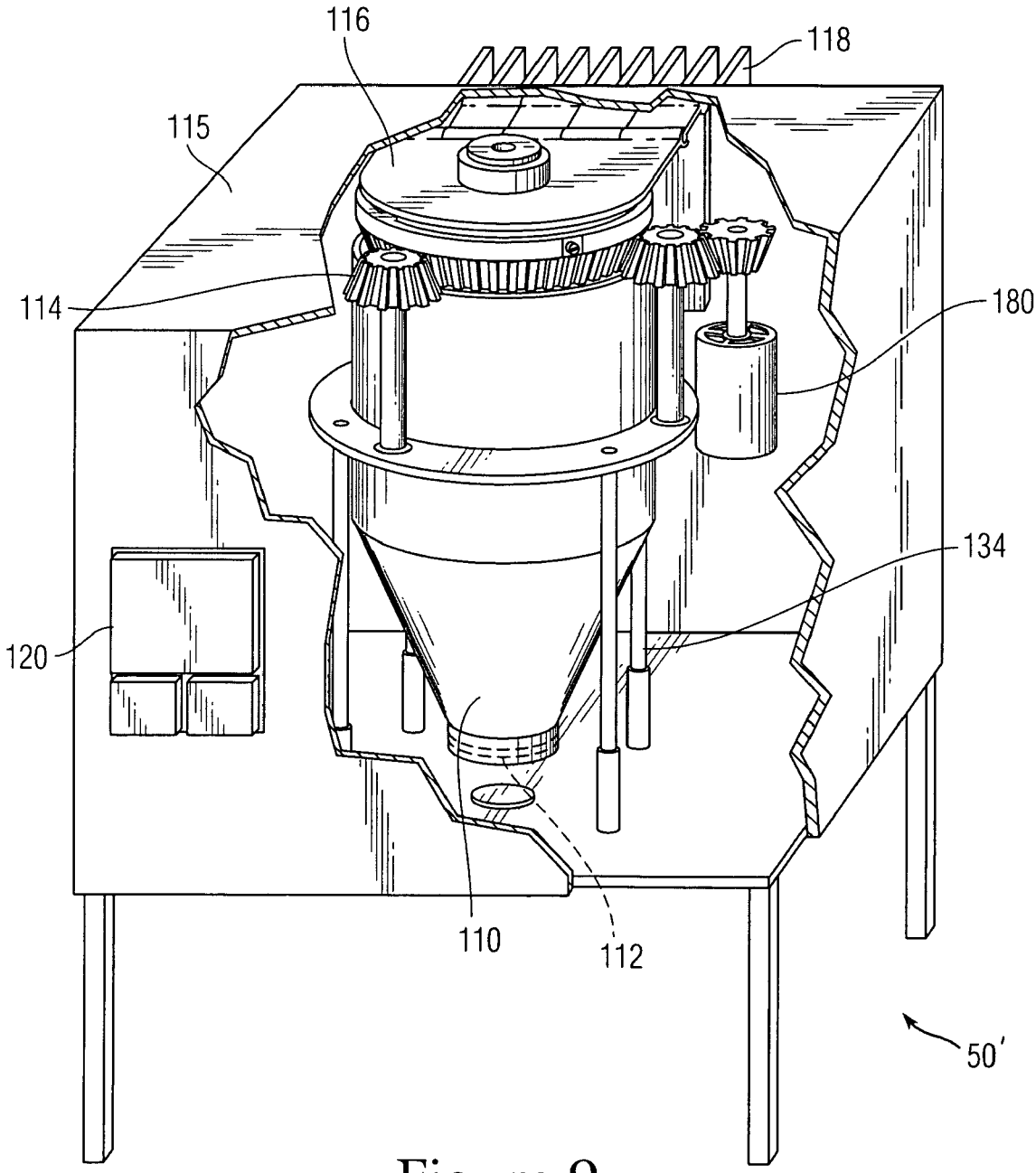
FIG. 9 shows a perspective view of another embodiment of the rapid cooling apparatus according to the present teachings.
Figure 12:
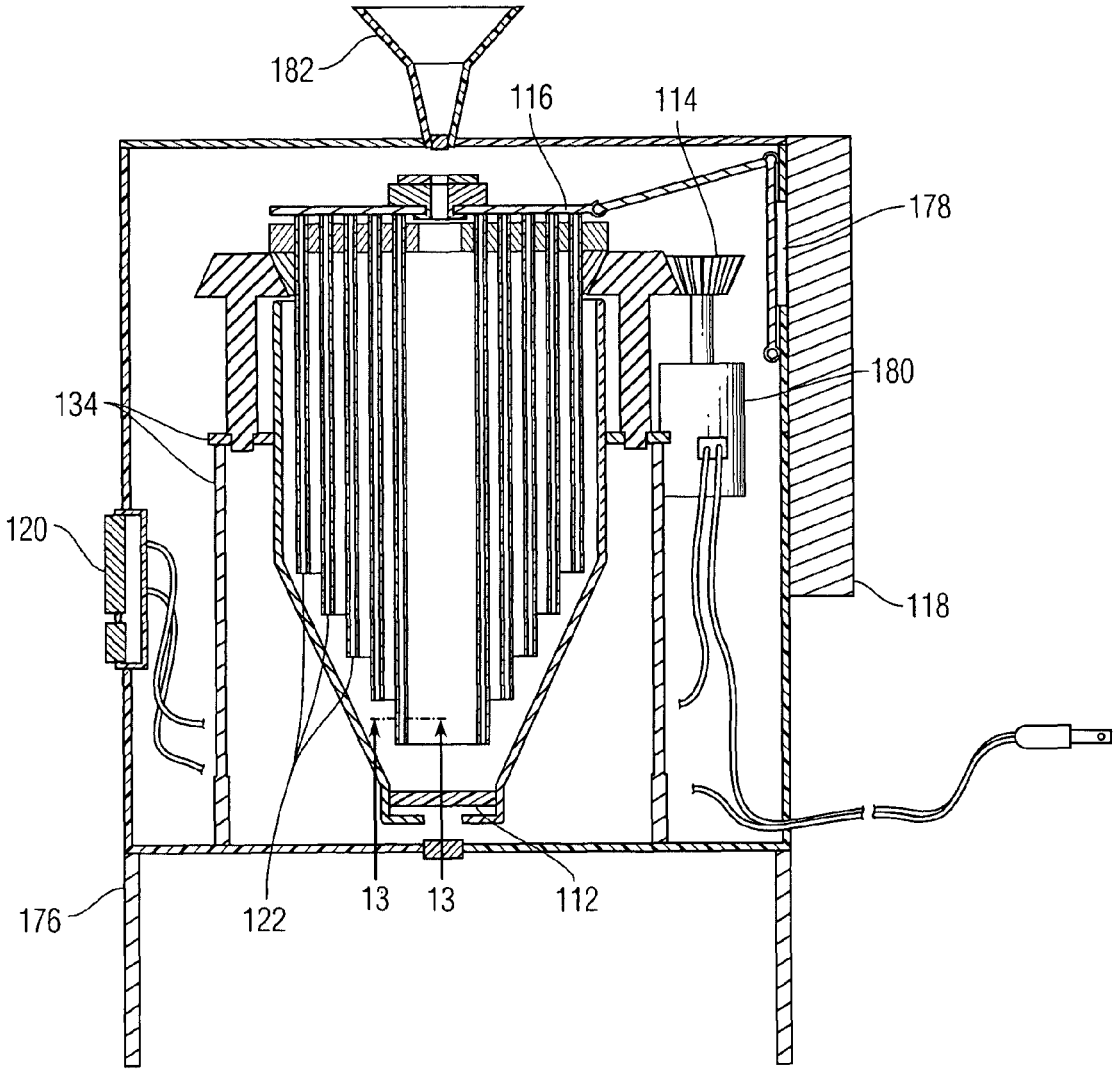
FIG. 12 shows a vertical, cross-sectional view from front to back of the rapid cooling apparatus according to various embodiments.

FIG. 9 shows an alternative embodiment of the rapid cooling apparatus 50' of the present teachings. As more fully discussed below, the cooling elements are formed as opposed cooling cylinders that are concentrically arranged. The concentrically arranged cooling cylinders can be rotated within a container shell 110 by way of a drive gear mechanism 114. Liquid that has been cooled by way of the concentric cooling cylinders can be drained through a valve 112 arranged at the bottom of the container shell 110. The rapid cooling apparatus 50' can be supported by housing 115, drive gear mechanism 114, and a scaffold structure 134. The concentrically arranged cooling cylinders can be cooled through contact with a hinged cold plate 116 that can be arranged in thermal contract with a thermoelectric chip 178, as shown in FIG. 12. The thermoelectric chip 178 can be arranged to expel heat through a heat sink 118 arranged at a rear of the rapid cooling apparatus 50'. An interface 120 on the rapid cooling apparatus 50' can be provided to allow a user to choose a target temperature, to select a cleaning mode, or to choose an ideal rate of rotation depending upon the fluid being cooled and the desired amount of cooling.

Figure 10:
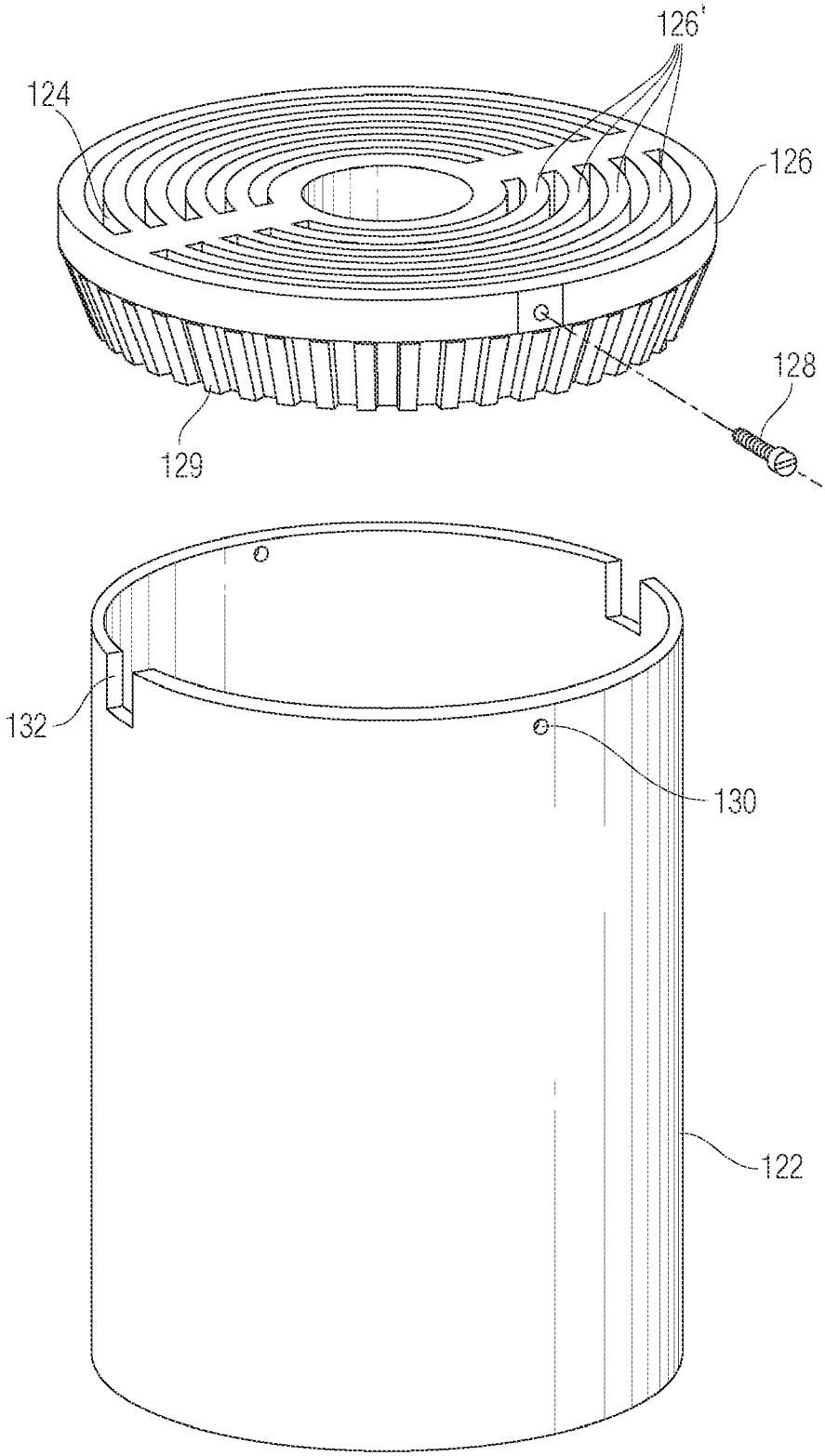
FIG. 10 is an exploded view of a cooling cylinder assembly showing a single cooling cylinder according to various embodiments.

FIG. 10 is an exploded view of a cooling cylinder assembly showing a single, rotatable concentric cooling cylinder 122 and a support member 126 that operates to secure a plurality of the cooling cylinders 122. Each concentric cooling cylinder 122 can be arranged to slide into two corresponding arc-shaped slots 124 formed in the support member 126. The concentric cooling cylinders 122 can be removable secured with one or more pins 128 by threading a pin 128 through the support member 126 and an aperture 130 formed in a wall of a cooling cylinder 122. Opposed notches 132 formed in the cooling cylinders 122 can be arranged to mate into the underside of the slotted support structure 126. Moreover, the inner and/or outer circumferential surfaces of each cooling cylinder 122 can be provided with surface undulations or projections which are capable of generating turbulence during rotation of the cooling cylinder 122 for enhancing cooling.

Figure 11:
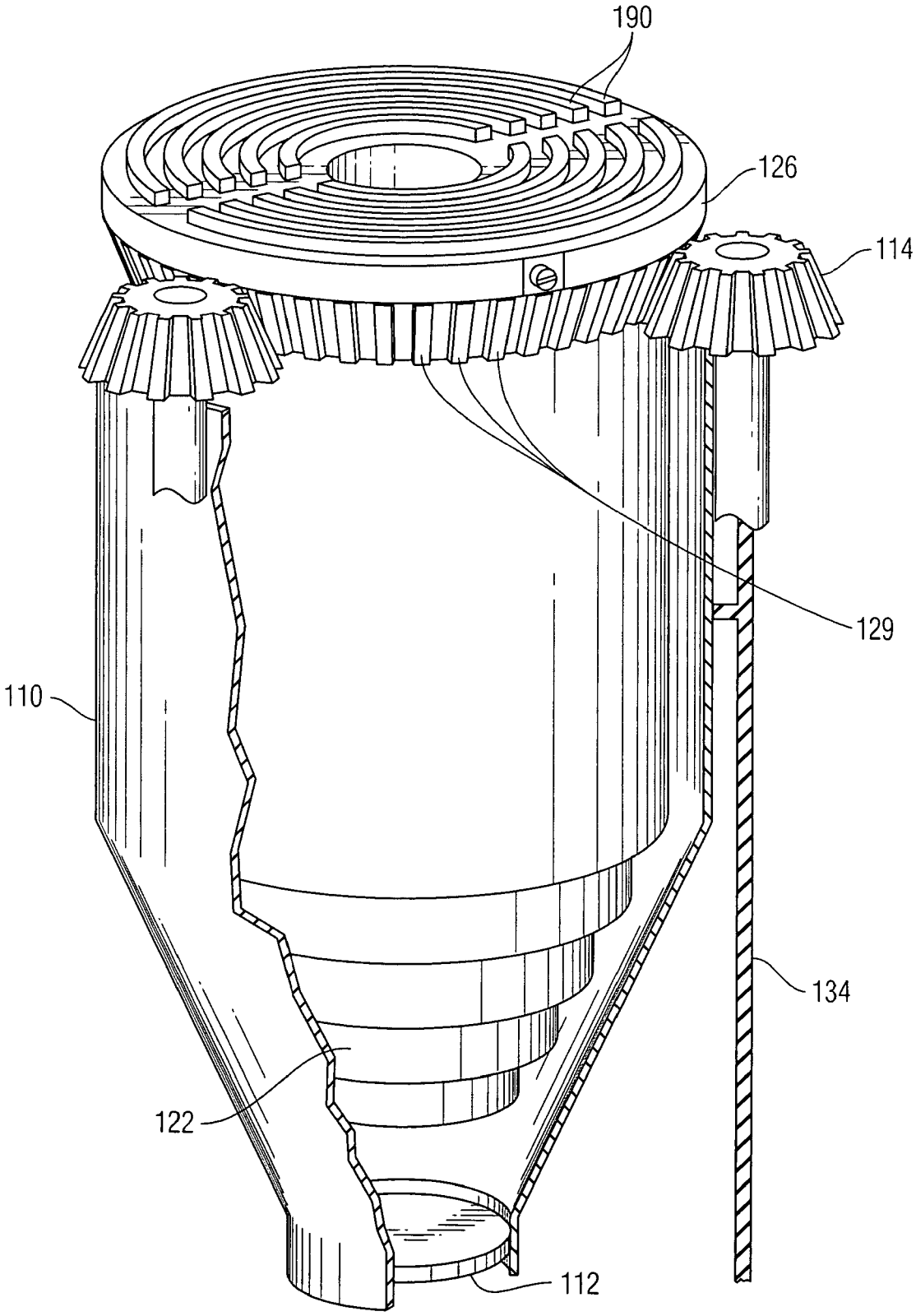
FIG. 11 is a perspective, cross-sectional view of a plurality of cooling cylinders secured to a support member according to various embodiments.

As shown in FIG. 11, end portions 190 of each of the cooling cylinders 122, when fully inserted and secured to the support member 126, can extend out above from the surface of the slotted support member 126. These end portions 190 can be placed in thermal contact with the hinged cold plate 116. Because of the thermal contact with the thermoelectric chip 178, the rapid cooling apparatus 50' of the present teachings can expel heat absorbed from the fluid being cooled quickly and can be used to cool successive batches of fluid with reduced delay.

Still referring to FIG. 11, the cooling cylinder assembly can be supported by the scaffold structure 134 and by the drive gear mechanism 114 which is arranged to mesh with correspondingly arranged teeth 129 formed on the support member 126. The concentric cooling cylinders 122 can be rotated within the stationary container shell 110 by the drive gear mechanism 114 when a motor is selectively energized by the user.

FIG. 12 illustrates a side view of the rapid cooling apparatus 50". The apparatus 50" can be suspended by legs 176 that allow a user to place a receptacle underneath the valve 112 to collect the liquid after cooling. The hinged cold plate 116 can be connected to the thermoelectric chip 178 while being arranged in thermal contact with the ends of the concentric cooling cylinders 122. The hinges of the cold plate 116 allow the cold plate 116 to be easily articulated to allow removal of the cooling cylinder assembly. A motor 180 can be arranged to drive the drive gear mechanism 114 and force the support member 126 to rotate. In operation, a user can pour a fluid to be cooled through a funnel 182 which directs the fluid into the concentric cooling cylinders 122 where it can be rapidly cooled.

When it is desired to cool a fluid, the user can then depress the proper button on the interface 120 to energize the motor 180 causing rotation of the concentric cooling cylinders 122 at a predetermined angular frequency. The angular frequency can be constant or varied by the user. Alternatively, a control system can vary the angular frequency during the cooling operation depending on the particular cooling requirements. Moreover, the amount of cooling can be controlled automatically through temperature sensors and a control circuitry. After a desired temperature has been reached, the cooled fluid can be poured out of the container shell 110 through the valve 112 and into a receptacle. Alternatively, if turbulence is expected to negatively affect properties of the fluid being cooled, the user can elect to not energize the motor 180.

To rinse or clean the rapid cooling apparatus 50', the user can fill the container shell 110 with water and/or a cleaning solution and can then energize the motor 180 causing the cooling cylinders 122 to rotate at a relatively high-speed and then to abruptly stop repeatedly, causing a cleaning of residues from the container shell 110 and the cooling cylinders 122. For deep, thorough cleaning, the cooling cylinders 122 can be readily separated from the support member 126 and hand-cleaned or placed into a dishwasher.

Figure 13:
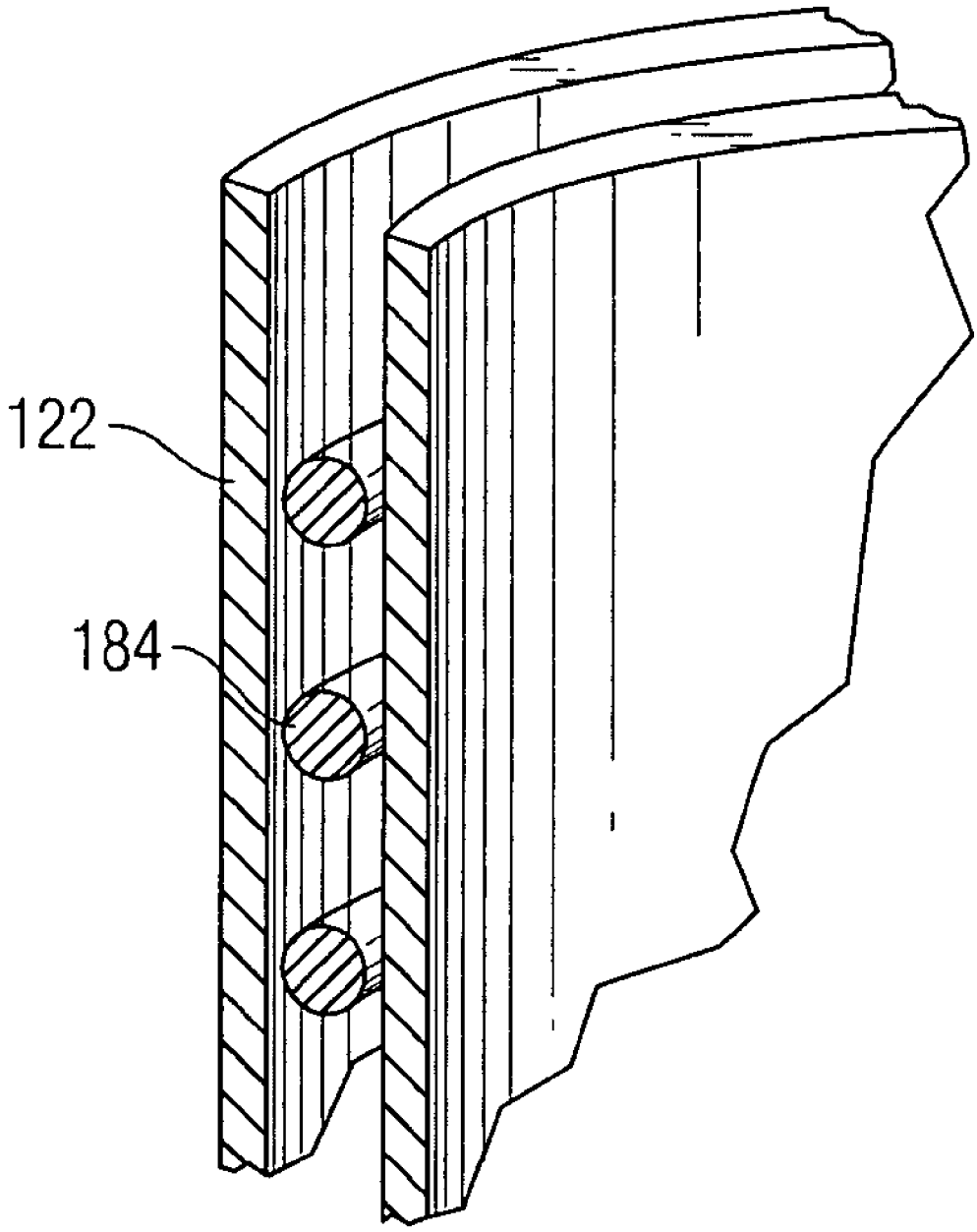
FIG. 13 shows a cross-section taken through a wall of a cooling cylinder at 13-13 of FIG. 12.

FIG. 13 is a cross-section through a wall of one of the cooling cylinders 122. The interior of the cooling cylinders 122 can be hollow and can include one or more foam inserts 184 that can be supported within the cooling cylinders 122 by, for example, protrusions. The foam inserts 184 can be arranged to contract and relieve pressure formed inside of the cylinder walls when fluids within the cooling cylinders 122 change states.

According to various embodiments, each of the cooling cylinders 122 can have a thickness of from about 2 mm to about 2 cm, and preferably can have a thickness of about 4 mm to about 5 mm. The support member 126 can include a plurality of spacers 126' arranged to provide a separation distance between cooling cylinders 122 of up to about 1 cm, and preferably can provide a mean separation distance of between about 2 mm to about 3 mm, and most preferably about 2.5 mm. An outer diameter of each cooling cylinder 122 can vary depending on the desired amount of cooling and can generally range from about 7 cm to about 20 cm. All noted dimensions can be varied depending upon the desired rate of cooling and the size of the cooling cylinders.

Figure 14:
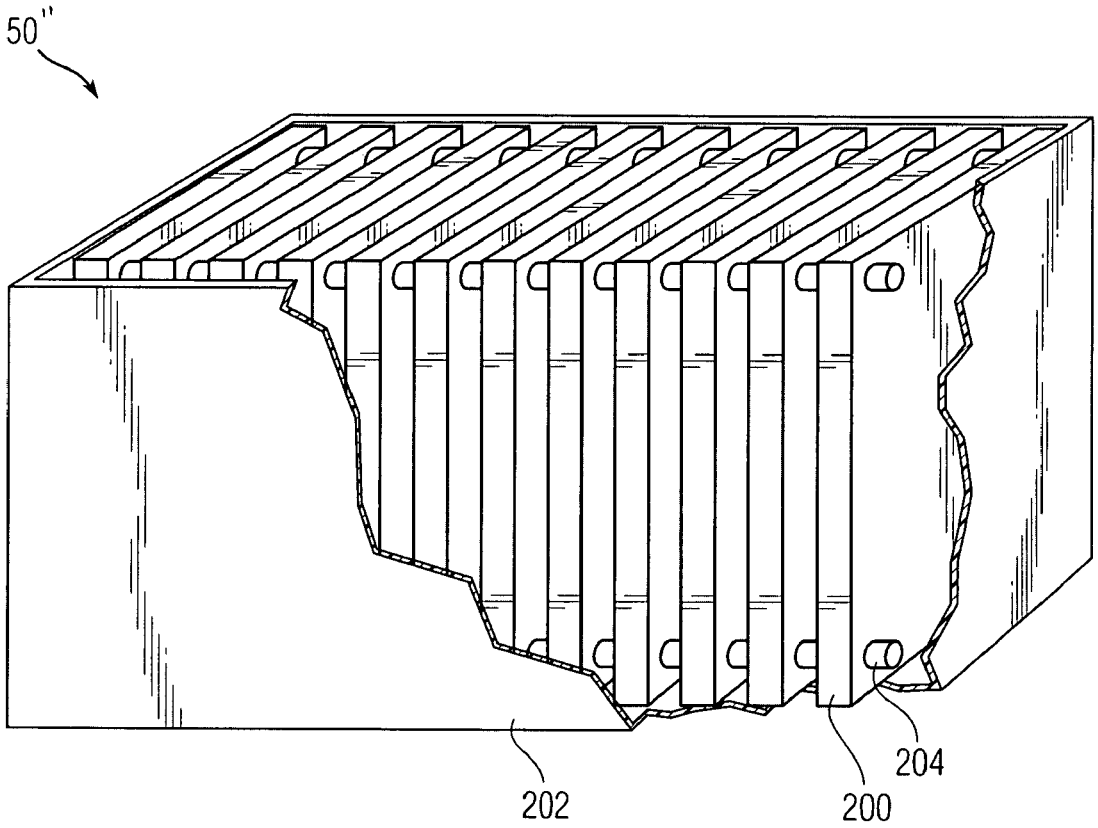
FIG. 14 shows a perspective view of yet another embodiment of the rapid cooling apparatus according to the present teachings.
Figure 15:
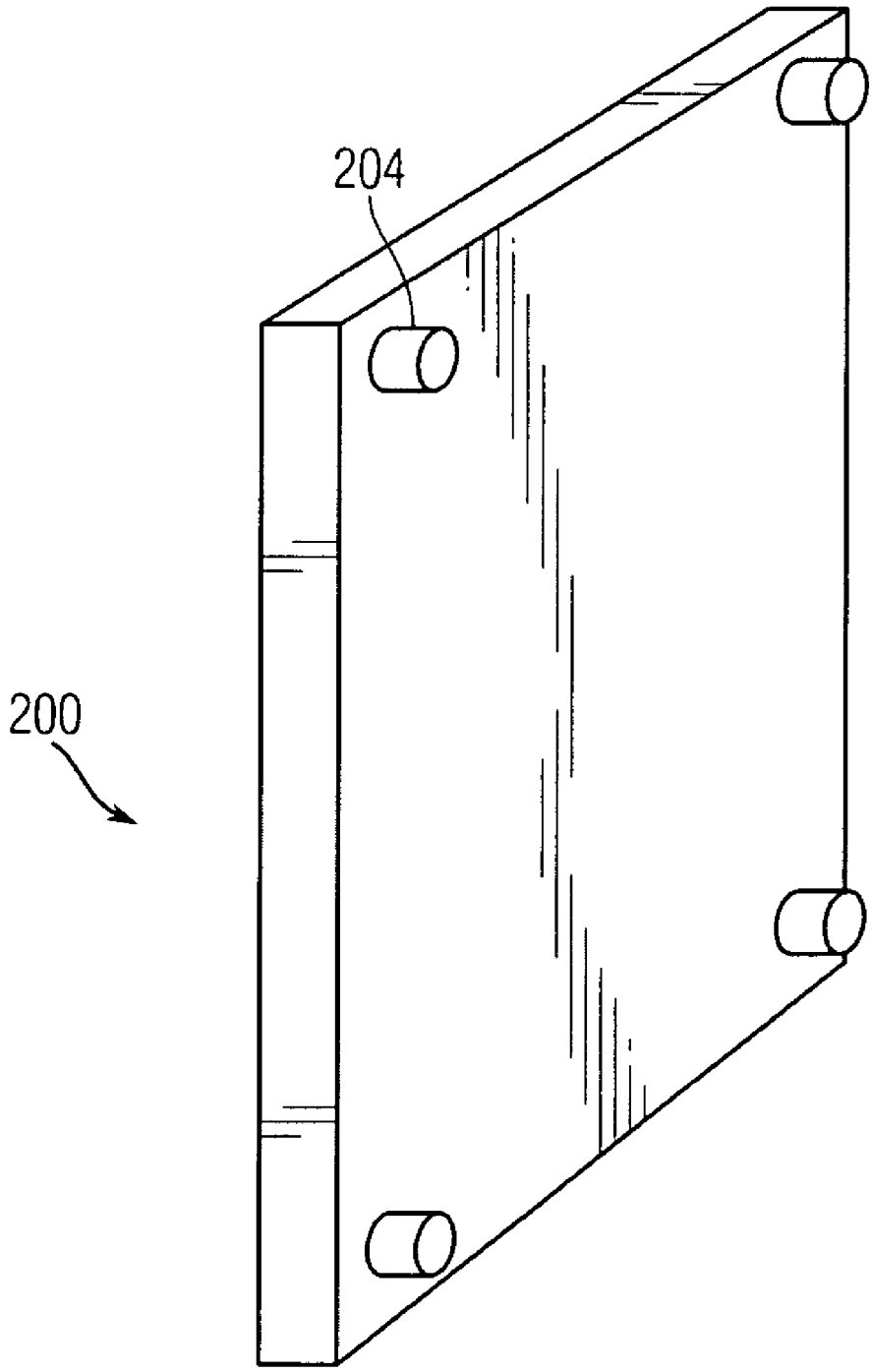
FIG. 15 shows a perspective view of a cooling plate according to various embodiments.

FIG. 14 shows yet another alternative embodiment of the rapid fluid cooling apparatus 50" of the present teachings. The rapid cooling apparatus 50" can include a plurality of cooling elements in form of rectangular plates 200 which can be arranged in a generally parallel relationship. As shown in FIGS. 14 and 15, the cooling plates 200 can be placed within a container 202 and separated by spacers 204 designed to provide a separation distance with an optimized surface-to-volume ratio between opposed plates 200 and the fluid being cooled. The spacers 204 can be designed to support and separate the opposed rectangular plates 200 in a secured manner while allowing each plate 200 to be independently separated for ready cleaning by hand or in a dishwasher. For example, each of the opposed rectangular plates can have spacers 204 friction fit into its surface. Alternatively, the spacers 204 can be formed by enlarged screwheads that extend from a surface of a cooling plate 200.

Figure 16:
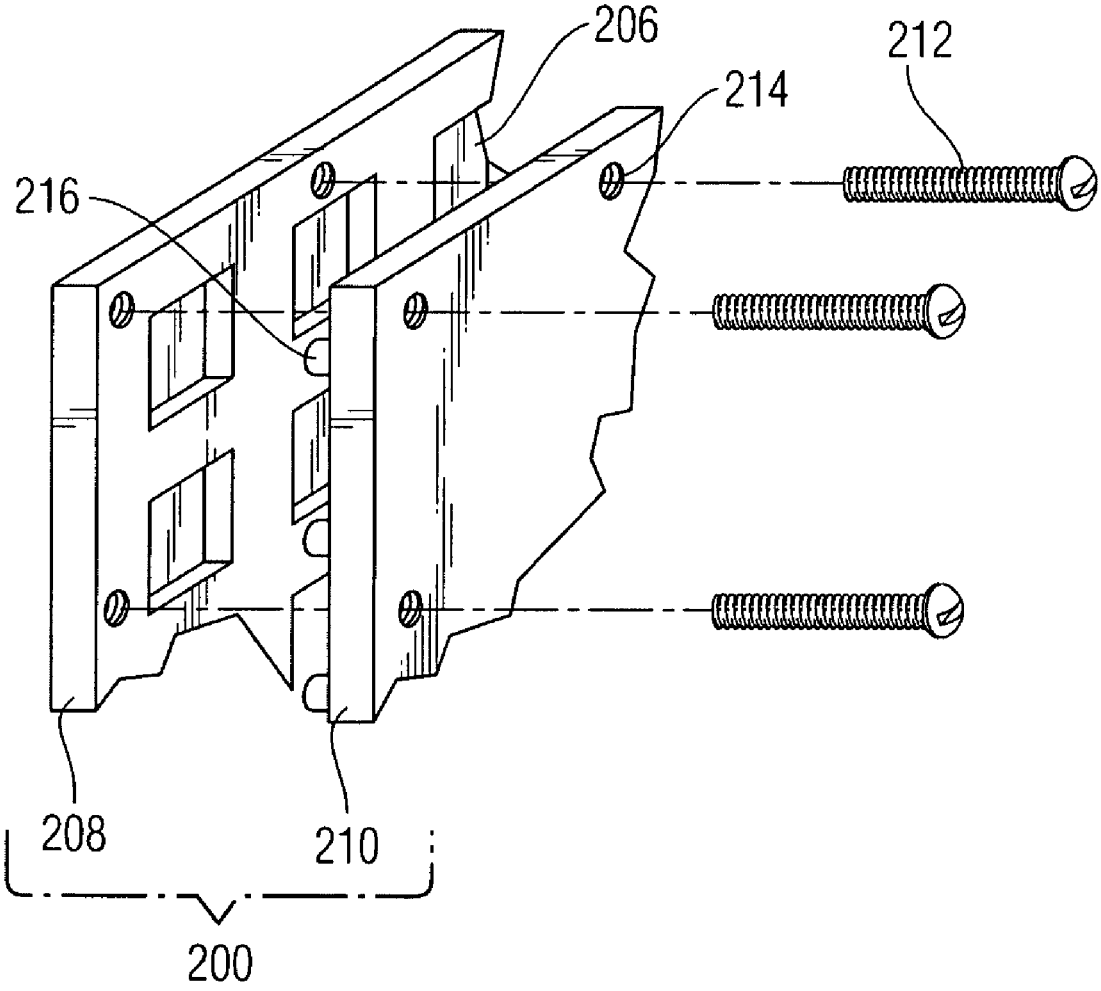
FIG. 16 shows an exploded, perspective view of a cooling plate according to various embodiments.

FIG. 16 illustrates the structure and assembly of one of the plate-shaped cooling elements 200. Each plate-shaped cooling element 200 can be formed by opposed plates 208, 210 with at least one of the opposed plates being arranged with one or more cavities 206 forming a cooling fluid chamber. One or more gaskets can be arranged between opposed plates 208, 210 to promote the sealing of the cooling fluid chamber. A cooling fluid, such as, for example, water, can be provided within the sealed cooling fluid chamber 206. The one or more cooling fluid chambers 206 can be filled with a quantity of fluid such that freezing the cooling fluid does not expand and exceed the volume of the cooling chamber. According to various embodiments and as shown in FIG. 16, square-shaped cavities 206 in one of the opposed plates 208 can extend about a post 112 formed on the second plate 210. The opposed plates 208, 210 can be tightly coupled to each other by way of a securing mechanism, such as screws 216 and threaded holes 214.

In use, the assembly of cooling plates 200 and the container 202 can be stored in a reduced temperature environment, such as, for example, a freezer where they can be cooled and maintained at sub-freezing temperatures. When it is desired to cool a fluid, the assembly of cooling plates 200 is removed from the reduced temperature environment and the fluid to be cooled is then poured over the cooling plates and held within the liquid container 202 thereby rapidly cooling the fluid. After a desired temperature is reached, the cooled fluid can be poured out of the liquid container 202. To clean the assembly of cooling plates 200, each of cooling plates 200 is separated and hand-cleaned or placing into a dishwasher.

According to various embodiments, in an assembled state, a plate-shaped cooling element 200 can have a thickness of from about 2 mm to about 2 cm, and preferably can have a thickness of about 4 mm to about 5 mm. The spacers 204 can be arranged to provide a separation distance between opposed cooling elements 200 of up to about 1 cm, and preferably are arranged to provide a mean separation distance of between about 2 mm to about 3 mm, and most preferably about 2.5 mm. All noted dimensions can be varied depending upon the desire rate of cooling and the size of the cooling elements. Moreover, the outer surfaces of at least one of the opposed plates 208, 210 can be provided with surface undulations or projections which are capable of generating turbulence when a fluid to be cooled is poured over the plate-shaped cooling elements 200 for enhanced cooling.

The present teachings also relate to a method of rapidly cooling a fluid. The method includes providing a plurality of cooling elements, each of the cooling elements including a housing including a sealed cooling fluid chamber filled with a cooling fluid. Each of the cooling elements are arranged spaced apart from an opposed cooling element and are independently separable from the other cooling elements. The method includes reducing the temperature of the plurality of cooling elements by exposing the cooling elements to a reduced temperature element. The method further includes arranging the cooling elements in a container and then pouring a fluid to be cooled into the container. A further feature of the method includes rotating the plurality of cooling elements within the container.

According to various embodiments, the cooling elements of the rapid fluid cooling apparatus can be made from a material possessing high heat conducting properties, such as, for example, aluminum, stainless steel, copper, and various plastics, or a combination thereof. Moreover, the cooling elements of the apparatus can be heated, rather than cooled, to allow the rapid heating of a fluid. To reduce residue being left on the cooling elements, a non-stick surface may be applied to the surfaces thereof.

The rapid cooling apparatus and method of the present teachings provides various advantages. For example: 1) when the cooling fluid possesses a significantly depressed freezing point, cooling can be accelerated because frozen solution maintains its temperature before melting, maintaining a steep temperature gradient between the cooling medium and frozen solution; 2) when using rotating cooling elements that are symmetric along their axis of rotation, velocity differences between the motion of the wall of the cooling element and the enclosed cooling fluid leads to improved mixing and heat transfer within the cooling element; 3) the cooling elements can be compact because the latent heat of fusion of the cooling fluid can create a high capacity for heat absorption; 4) the high-density cooling capacity design of the cooling elements allows the apparatus to incorporate a small liquid container, resulting in high energy efficiency as the surrounding insulation has reduced surface area; 5) when cooling is achieved using a thermoelectric chip, the design of the apparatus limits heat load by virtue of its reduced size; 6) the apparatus can rapidly chill different types of fluids in succession, making it a more versatile tool compared to known machines dedicated to cooling a single species of liquid; 7) the apparatus requires a minimum of effort and attention; 8) the cooling elements can be easily cleaned using high-speed rotary motion utilizing a built-in programmed, cleaning cycle; 9) the assembly of cooling elements can be easily disassembled allowing ready access to all surfaces for thorough, safe cleaning, and enabling use with a plurality of liquid species in succession; 10) surfaces in contact with the fluid to be cooled can be at sub-freezing temperatures during storage discouraging the presence of pathogens; 11) a temperature sensor on the apparatus can accurately assess the average temperature of the fluid being cooled and precisely target final temperature of the rapid cooling process; 12) simultaneous cooling of the entire batch of fluid obviates the need for winding conduits and complicated seals; 13) unlike a conventional heat exchangers having heating or cooling elements that are permanently connected to a source, the cooling elements of the apparatus are independent and readily separable; 14) the cooled elements can absorb large quantities of heat obviating the need for secondary heat absorbers, simplifying design.

Although the description above contains many specificities, these should not be construed as limiting the scope of the present teachings but as merely providing illustrations of some of the presently preferred embodiments of the present teachings. For example, mixing in and improved heat exchange with a warm fluid can be encouraged by raising impediments to laminar fluid flow and increasing surface area by, for example, having a radially undulating surface instead of a pure cylinder in one embodiment or raised vertical obstructions on opposed faces of the rotating discs; a thin removable layer, such as a plastic skin, can be placed on a surface of one of the cooling elements; warm fluid or cleaning solution lines can be connected to the apparatus to automate cooling or cleaning; rapid acceleration promotes formation of strong shear forces, turbulence, and oblique pressure and, therefore, stopping, starting, and reversing directions of acceleration will also lead to effective cooling; an alternate method of generating mixing or cleaning is to provide a rotating arm with a scraper; the opposed surfaces described in the above embodiments can be canted relative to vertical.

What is claimed is:

1. A rapid fluid cooling apparatus comprising:

a plurality of cooling elements, each of the cooling elements including a housing forming a sealable cooling fluid chamber capable of containing a cooling fluid;

at least one spacer separating opposed cooling elements and providing a predetermined separation distance between the opposed cooling elements when the cooling elements are secured in an operable position; and a container capable of receiving the plurality of cooling elements and holding a liquid to be cooled;

wherein each of the plurality of cooling elements are arranged to be independently separable.

2. The rapid fluid cooling apparatus of claim 1, wherein a mean separation distance between opposed cooling elements is less than about 1 cm.

3. The rapid fluid cooling apparatus of claim 2, wherein the mean separation distance between opposed cooling elements is about 2 mm to about 3 mm.

4. The rapid fluid cooling apparatus of claim 1, wherein the cooling fluid chamber of at least one of the cooling elements includes a heat-conducting fin.

5. The rapid fluid cooling apparatus of claim 1, wherein the plurality of cooling elements includes a stack of disc-shaped cooling elements.

6. The rapid fluid cooling apparatus of claim 5, further comprising a container into which the plurality of disc-shaped cooling elements is capable of being removably inserted.

7. The rapid fluid cooling apparatus of claim 6, further comprising a motor arranged to rotate the plurality of disc-shaped cooling elements when inserted in the container.

8. The rapid fluid cooling apparatus of claim 1, wherein the plurality of cooling elements includes at least two concentrically arranged cylinders.

9. The rapid fluid cooling apparatus of claim 8, wherein the plurality of concentric cylinder cooling elements is capable of being removably inserted into the container.

10. A rapid fluid cooling apparatus comprising:

a plurality of cooling elements, each of the cooling elements including a housing forming a sealable cooling fluid chamber capable of containing a cooling fluid, the plurality of cooling elements including at least two concentrically arranged cylinders;

at least one spacer separating opposed cooling elements and providing a separation distance between the opposed cooling elements;

a container into which the plurality of cooling elements is capable of being removably inserted; and a motor arranged to rotate the plurality of cooling elements when inserted in the container;

wherein each of the plurality of cooling elements are arranged to be independently separable.

11. The rapid fluid cooling apparatus of claim 1, wherein the plurality of cooling elements includes at least two planar plates arranged substantially parallel to one another.

12. The rapid fluid cooling apparatus of claim 6, further comprising surface undulations or projections arranged on one or more surfaces of at least one of the plurality of cooling elements capable of generating turbulence during rotation of the cooling element.

13. A method of rapidly cooling a fluid comprising:

providing a plurality of cooling elements, each of the cooling elements including a housing including a sealed cooling fluid chamber filled with a cooling fluid, each of the cooling elements being spaced apart from an opposed cooling element at a predetermined separation distance and being independently separable from the other cooling elements;

reducing the temperature of the plurality of cooling elements by exposing the cooling elements to a reduced temperature;

arranging the cooling elements in a container; and pouring a fluid to be cooled into the container.

14. The method of claim 13, wherein each of the opposed cooling elements are spaced apart by less than about 1 cm.

15. A method of rapidly cooling a fluid comprising:

providing a plurality of cooling elements, each of the cooling elements including a housing including a sealed cooling fluid chamber filled with a cooling fluid, each of the cooling elements being spaced apart from an opposed cooling element and being independently separable from the other cooling elements;

reducing the temperature of the plurality of cooling elements by exposing the cooling elements to a reduced temperature;

arranging the cooling elements in a container;

pouring a fluid to be cooled into the container; and rotating the plurality of cooling elements within the container.

16. The method of claim 13, further comprising pouring the fluid to be cooled from the container after the fluid has been cooled by the cooling elements.

17. A method of rapidly cooling a fluid comprising:

providing a plurality of cooling elements, each of the cooling elements including a housing including a sealed cooling fluid chamber filled with a cooling fluid, each of the cooling elements being spaced apart from an opposed cooling element and being independently separable from the other cooling elements;

reducing the temperature of the plurality of cooling elements by exposing the cooling elements to a reduced temperature;

arranging the cooling elements in a container;

pouring a fluid to be cooled into the container;

pouring the fluid to be cooled from the container after the fluid has been cooled by the cooling elements; and placing a cleaning solution into the container and rotating the plurality of cooling elements.

18. The method of claim 13, wherein reducing the temperature of the plurality of cooling elements includes freezing the cooling fluid housed in each of the plurality of cooling elements.

19. The method of claim 13, wherein the plurality of cooling elements includes a stack of opposed disc-shaped cooling elements.

20. The method of claim 13, wherein the plurality of cooling elements includes at least two concentrically arranged cylinders.

* * * * *